United States Patent [19]

Yamamura et al.

[11] 4,360,391

[45] Nov. 23, 1982

[54] PROCESS FOR PRODUCTION OF COIL OF HOT ROLLED STRIP OF AUSTENITIC STAINLESS STEEL

[75] Inventors: Takamasa Yamamura, Tokyo; Seiji Mori, Ichikawa; Koichi Asada, Kure; Kenichi Shinoda, Hiroshima; Yuichi Higo, Kure, all of Japan

[73] Assignee: Nisshin Steel Co., Ltd., Japan

[21] Appl. No.: 266,586

[22] Filed: May 22, 1981

[51] Int. Cl.[3] ..... C21D 8/02

[52] U.S. Cl. ..... 148/12 E

[58] Field of Search ..... 148/12 E, 12.4

[56] References Cited

U.S. PATENT DOCUMENTS 3,844,846 10/1974 Friske et al. ..... 148/12 E 4,086,105 4/1978 Mayrhofer et al. ..... 148/12 E 4,217,150 8/1980 Hartline ..... 148/12 E

*Primary Examiner*—W. Stallard

*Attorney, Agent, or Firm*—Kane, Dalsimer, Kane, Sullivan and Kurucz

[57] ABSTRACT

A process for producing a coil of a hot rolled austenitic steel strip wherein a hot bar of austenitic stainless steel is hot rolled to a strip by multiple pass rolling with a total rolling reduction and finishing temperature controlled within the hatched area of FIG. 1; and wherein the hot rolled strip is allowed to cool in air for 3 to 10 seconds, cooled with water and then coiled at 400° to 600° C. The product has recrystallization substantially completed and sensitization prevented, and therefore, need not be annealed before it is subjected to a pickling process.

2 Claims, 12 Drawing Figures

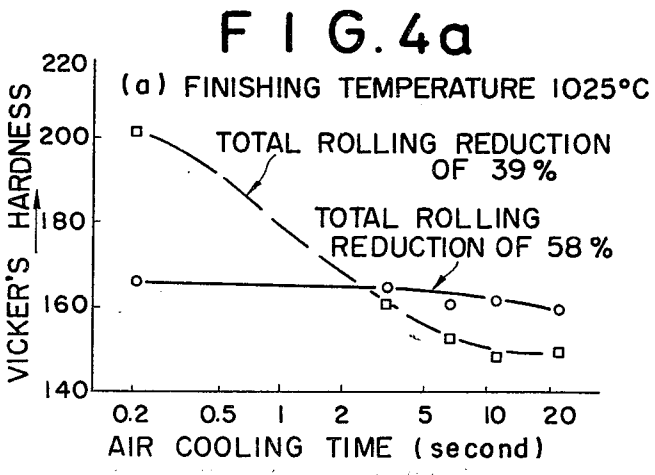
FIG. 4a
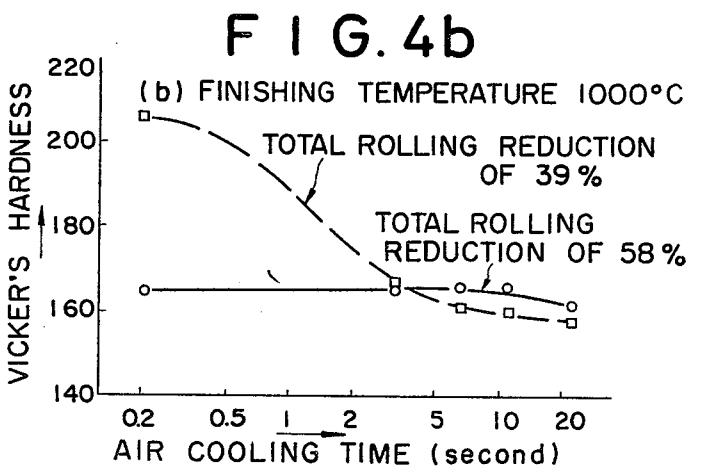
FIG. 4b
FIG. 4c
FIG. 4d

PROCESS FOR PRODUCTION OF COIL OF HOT ROLLED STRIP OF AUSTENITIC STAINLESS STEEL

BACKGROUND OF THE INVENTION

The present invention relates to a novel process for the production of a coil of a hot rolled strip of austenitic stainless steel. Because the coil produced by the process of the invention already has recrystallization substantially completed and sensitization prevented, the subsequent annealing step may be omitted.

A coil of a hot rolled strip of austenitic stainless steel obtained by a conventional hot rolling process has a structure of not yet substantially recrystallized austenite and/or is in the so-called sensitized state. By the term "sensitized state," is meant that the coil contains carbides which have precipitated on grain boundaries or deformation bands in the course of slow cooling after coiling. Such a coil is hard and has a poor formability. Moreover it poses a problem as to the corrosion resistance which is inherent to stainless steel. Accordingly the coil is usually passed through a continuous annealing and pickling line, in which it is subjected to a heat treatment for the purposes of recrystallization annealing as well as dissolution of carbides and to a pickling process for the removal of scales, whereby a hot rolled stainless steel product or a material for cold rolling is produced.

The continuous annealing and pickling line is industrially very stable and is a large scale installation comprising an apparatus for solution treatment (generally comprised of a catenary annealing furnace maintained at a temperature of about 1100° C. and a quenching device such as a spray cooler), an apparatus for descaling (such as a shot blast), two or three vessels for pickling, scrubbers, washers, a drier and a coiler. However, the continuous annealing and pickling line bears various economical and technical burdens. Since a coil which has been allowed to cool to ambient temperature is reheated to a temperature of about 1100° C. to recrystallize and to dissolve carbides, considerable amounts of heat energy are consumed. When some parts of the line are stopped for some reasons, an overheating or an excessive pickling frequently may occur. Moreover surface defects may occur when the coil is uncoiled and carried by rolls through the reheating furnace.

If the annealing step can be omitted, the manufacturing process may be released from the above-mentioned various economical and technical burdens. In addition various advantages are expected including reduction in the total length of the production line, reduction in costs for installation and maintenance, and no need for stopping the line.

SUMMARY OF THE INVENTION

An object of the invention is to provide a process for the production of a coil of a hot rolled strip of austenitic stainless steel which may omit an annealing step.

We have found that a coil of a hot rolled strip of austenitic stainless steel, which has recrystallization substantially completed and sensitization prevented and, therefore, need not be annealed, can be produced by a process wherein a hot bar of austenitic stainless steel is hot rolled to a strip by passing through a train of finishing mill stands with a total rolling reduction and a finishing temperature controlled so that they fall within the hatched area shown in FIG. 1 of the attached drawings; and wherein the hot rolled strip so obtained is allowed to cool in air for a period of from 3 to 10 seconds cooled with water, and then coiled at a temperature of from 400° to 600° C. The hot bar may be a thickness of from 15 to 50 mm.

BRIEF EXPLANATION OF THE DRAWINGS

The invention will be further described with reference to the attached drawings, in which:

FIG. 4*a* shows a dependency of the Vicker's hardness on the air cooling time in second with a finishing temperature of 1025° C. in the case of three stands rolling;

FIG. 4*b* shows a dependency of the Vicker's hardness on the air cooling time in second with a finishing temperature of 1000° C. in the case of three stands rolling;

FIG. 4*c* shows a dependency of the Vicker's hardness on the air cooling time in second with a finishing temperature of 975° C. in the case of three stands rolling;

FIG. 4*d* shows a dependency of the Vicker's hardness on the air cooling time in second with a finishing temperature of 950° C. in the case of three stands rolling;

DETAILED DESCRIPTION OF THE INVENTION

Figure 1:
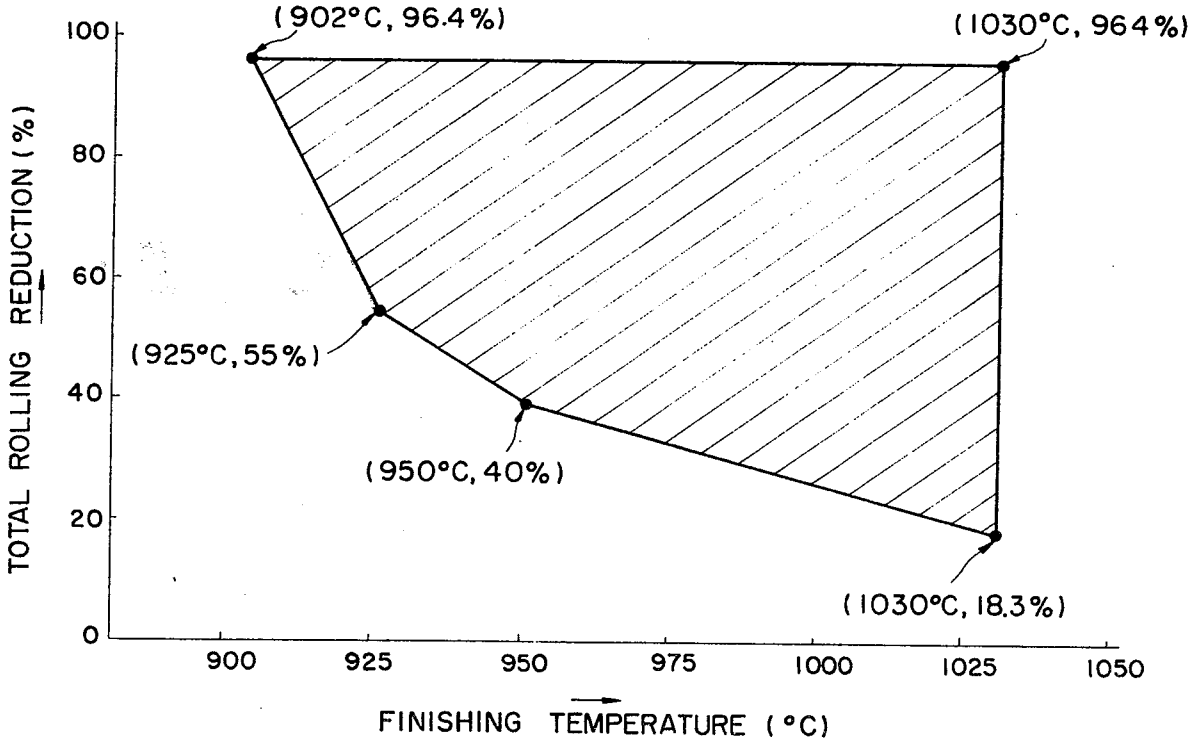
FIG. 1 is a graphical representation of the total rolling reduction and the finishing temperature which may be used in carrying out a process according to the invention.

Referring to FIG. 1, the hatched area can be represented by the following numerical formulae in which R represents the total rolling reduction (%) and T represents the finishing temperature (°C.).

$902 \leqq T \leqq 1030,\ 18.3 \leqq R \leqq 96.4$ $R \geqq 293-(4/15)T$ (in which T is from 950° to 1030°)

$R \geqq 610-(3/5)T$ (in which T is from 925° to 950° C.)

$R \geqq 1720-(9/5)T$ (in which T is from 902° to 925° C.)

By the term "finishing temperature" is meant a temperature of the hot rolled strip leaving the last stand of the train of finishing mill stands.

It is well known that a hot bar of austenitic stainless steel may be hot rolled to a strip by passing it through a train of finishing mill stands at temperatures of from about 1050° C. to about 850° C. Since austenitic stainless steel has a large deformation resistance at such temperatures, a satisfactorily high rolling reduction cannot be achieved on each stand of a train of finishing mill stands. It is also known that under such hot rolling conditions recrystallization of austenitic stainless steel is retarded to a great extent, as reported in Transaction ISIJ, Vol. 11, 1971, p. 359. In other words, there is no sufficient time for the austenitic stainless steel to be allowed to recrystallize when it is caused to pass from stand to stand within one or two seconds. It is believed that the integrated total rolling reduction affects the recrystallization behavior of the hot rolled strip.

Figure 2:
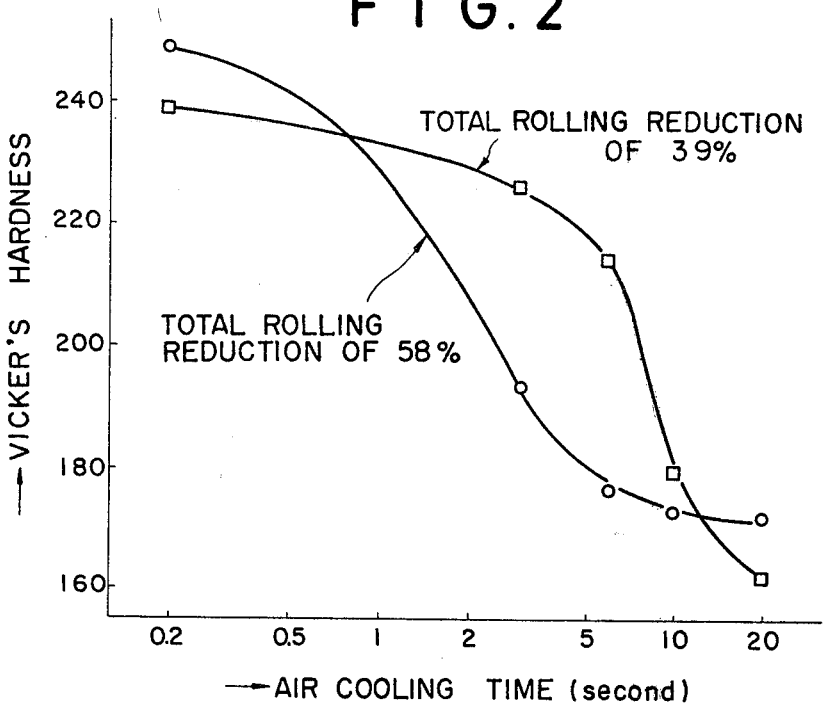
FIG. 2 shows a dependency of the Vicker's hardness on the air cooling time in second with a finishing temperature of 925° C. in the case of three stands rolling.

We studied effects of the total reduction and air cooling time on recrystallization of the hot rolled strip. By the term "air cooling time, " we mean a period of time in seconds for which the as-rolled strip is allowed to cool in air. The tests were carried out on 18Cr-8Ni specimens having a thickness of 20 mm, using a laboratory mill comprising three rolling stands. In each test the specimen was heated to a temperature of 1030° C. to obtain a grain size of about 40 microns and passed through the mill with a transit time of 2 seconds from stand to stand and a finishing temperature of 925° C. The hot rolled specimen was allowed to cool in air for a predetermined period of time, quenched and then tested for the Vicker's hardness. The results are shown in FIg. 2, in which white circles relate to the case wherein the total rolling reduction was 58%, (individual rolling reductions in the first, second and third stands being 30%, 25% and 20%, respectively), while white squares relate to the case wherein the total rolling reduction was 39%, (individual rolling reductions in the first, second and third stands being 20%, 15% and 10%, respectively). The reduction in the Vicker's hardness is a measure of the extent of recrystallization.

Figure 3:
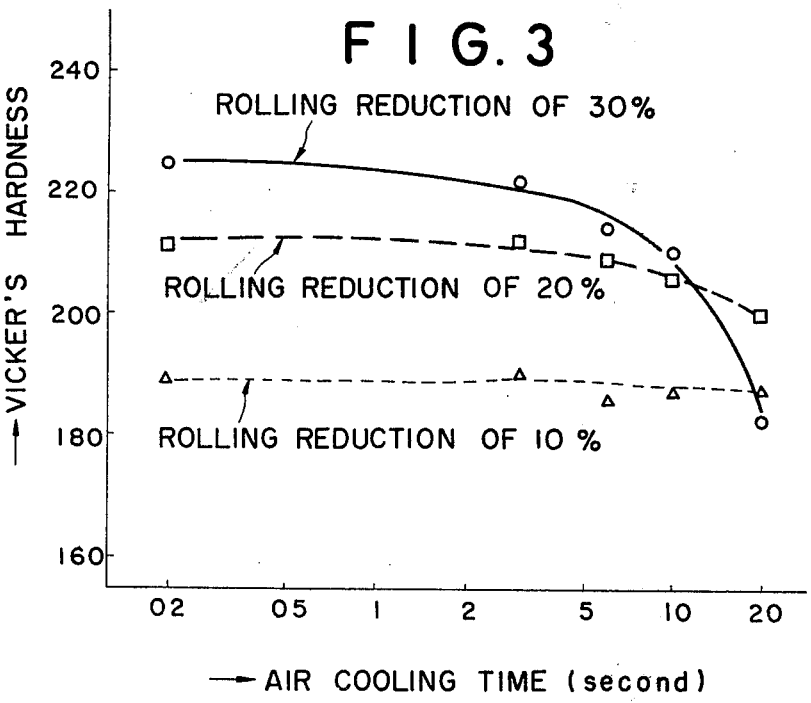
FIG. 3 shows a dependency of the Vicker's hardness on the air cooling time in second with a finishing temperature of 925° C. in the case of one stand rolling.

For comparative purposes one stand rolling was studied using similar specimens. The tests were carried out similarly, except that the specimens were subjected to single pass rolling. The results are shown in FIG. 3, in which black circles, black squares and black triangles relate to rolling reduction of 30%, 20% and 10%, respectively.

It is revealable that in the case of one stand rolling with a reduction of up to 30% (FIG. 3), air cooling within a period of 10 seconds does not ensure appreciable recrystallization softening. Whereas, in the case of three stands rolling (FIG. 2), the hot rolled strip becomes rapidly softened when it is allowed to cool in air, inspite of the fact that the rolling reduction in the last stand was only 10 to 20%. In the case of a total reduction of 58%, recrystallization of the hot rolled strips is substantially completed within 10 seconds.

The tests, of which results are shown in FIG. 2, were repeated except that finishing temperatures of 1025° C., 1000° C., 975° C. and 950° C. were respectively used instead of the 925° C. The results are shown in FIGS. 4*a*, 4*b*, 4*c* and 4*d*, respectively.

Based on such that results as shown in FIGS. 2 and 4 we have selected the total rolling reduction and finishing temperatures shown in FIG. 1 as conditions required for the desired recrystallization. Generally speaking, when relatively high finishing temperatures are used, relatively low total rolling reductions are permissible, as is the case with FIGS. 4*a* and 4*b*. However, if the finishing temperature is as low as 925° C., a total rolling reduction of 39% is unsuitable (FIG. 2).

In addition to the suitably selected finishing temperature and total rolling reduction, the air cooling time, that is a period of time for which the hot rolled strip is allowed to cool in air, should also be suitably selected. An optimum air cooling time will depend upon a particular combination of the selected total rolling reduction and finishing temperature. Generally, when relatively high finishing temperatures are used, the air cooling time can be relatively short. We have found that in order to ensure the desired recrystallization substantially completed an air cooling time at least 3 seconds is necessary for any combination of the total reduction and finishing temperature falling within the hatched area shown in FIG. 1. A prolonged air cooling in excess of 10 seconds not only results in a substantial lowering of the temperature of the strip which is not effective for the promotion of the desired recrystallization, but also makes it necessary to use a longer runout table on which the as rolled strip is carried to a coiler while being allowed to cool in air and then cooled with water. Accordingly, the air cooling time should preferably be at most 10 seconds.

The austenitic stainless steel strip which has been, according to the invention, hot rolled under the conditions shown in FIG. 1, recrystallized on the runout table, is characterized by its extremely fine grains and does not tend to be sensitized.

Figure 5:
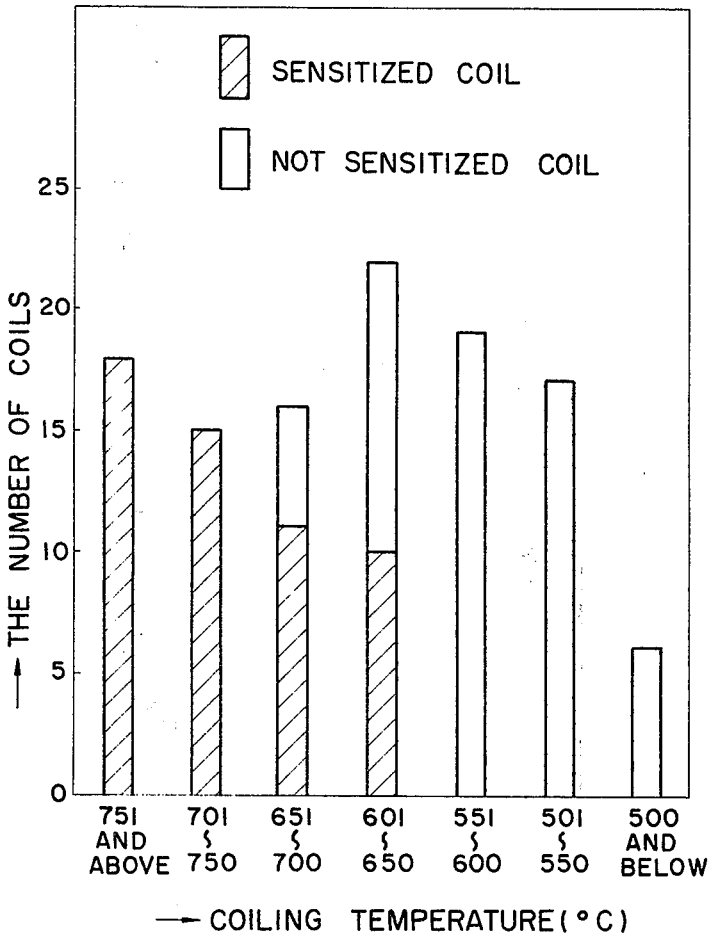
FIG. 5 shows a dependency of the number sensitized coils on the coiling temperature.

We have studied effects of the coiling temperature on sensitization. By the term "coiling temperature" we mean a temperature at which the cooled quenched strip is coiled. Coils, each having a thickness of 4.0 mm, a width of 1050 mm and a weight of about 7 tons, were prepared from slabs of 18Cr-8Ni stainless steel. The slab having a weight of about 7 tons was subjected to a rough rolling process to provide a hot bar having a thickness of about 22 mm. The hot bar was hot rolled to a strip by passing it through a finishing mill comprising 6 rolling stands with a total rolling reduction of 82% and a finishing temperature of 950° to 990° C., allowed to cool in air for a period of 3 to 6 seconds, cooled to a temperature widely varying from below 500° C. to above 751° C., coiled at the same temperature, and then allowed to cool to ambient temperature. A sample was taken from the middle part of each coil so produced, and tested for the presence of carbides. The results are shown in FIG. 5. In FIG. 5 each bar represents the number of coils which were cooled with water to temperature within the indicated range. The height of the hatched part of the bar represents the number of sensitized coils. FIG. 5 reveals that sensitization will be prevented if the hot rolled and recrystallized strip is cooled with water to a temperature of 600° C. or below before being coiled.

We have also found that the cooled strip should preferably be coiled at a temperature of 400° C. or higher, or otherwise surface defects and deterioration of the shape of coil frequently occur.

The invention will be further described by the following Examples.

In each Example, a slab of 18Cr-8Ni stainless steel having a weight of about 7 tons was subjected to a rough rolling process to provide a hot bar having a thickness of about 22 mm. The bar was hot rolled to a strip by passing it through a finishing mill comprising 6 rolling stands with a total rolling reduction of 82%. The thickness of the final product was 4 mm. The finishing temperature was varied as indicated below by changing a rate of rolling and a temperature to which the slab was heated.

Control Example 1

The bar was hot rolled with a finishing temperature of 890° C., allowed to cool in air on the full length of a runout table to a temperature of 710° C., coiled at the same temperature, and then allowed to cool to ambient temperature. A sample taken from the middle part of the coil exhibited a metallic structure shown in FIG. 6 and mechanical properties shown in Table 1.

Control Example 2

Figure 7:
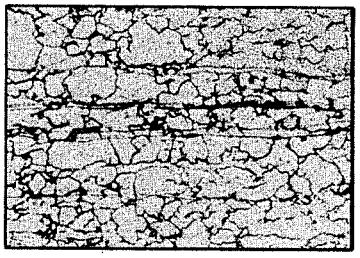

The bar was hot rolled with a finishing temperature of 920° C., allowed to cool in air on the full length of runout table to a temperature of 740° C., coiled at the same temperature, and then allowed to cool to ambient temperature. A sample taken from the middle part of the coil had a metallic structure shown in FIG. 7 and mechanical properties shown in Table 1.

The coil was solution treated at a temperature of 1080° C. The product so annealed had mechanical properties shown in Table 1.

EXAMPLE 1

Figure 8:
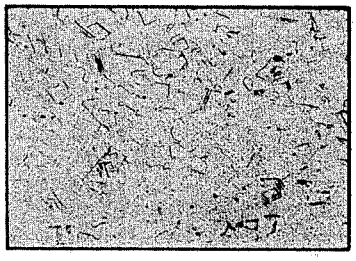

The hot bar was hot rolled with a finishing temperature of 950° C., allowed to cool in air on the runout table for a period of 6 seconds followed by subsequent water quenching and coiled on a water cooled coiler at a temperature of 520° C., and then allowed to cool to ambient temperature. A sample taken from the middle part of the coil had a metallic structure shown in FIG. 8 and mechanical properties shown in Table 1.

EXAMPLE 2

Figure 9:
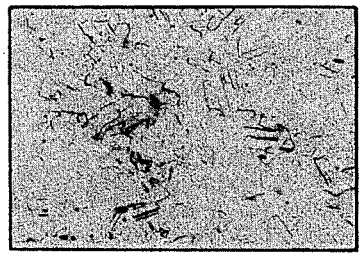

The procedure of Example 1 was repeated except that a finishing temperature of 960° C. was used instead of the 950° C. A sample taken from the middle part of the coil had a metallic structure shown in FIG. 9 and mechanical properties shown in Table 1.

TABLE 1

| | Hardness (Hv) | 0.2% Proof Stress ($kg/mm^2$) | Tensile Strength ($kg/mm^2$) | Elongation (%) | Reduction Ratio (%) |
|---|---|---|---|---|---|
| Control Example 1 | 254 | 52.3 | 78.1 | 45.5 | 19.1 |
| Control Example 2 | 201 | 42.5 | 74.0 | 48.8 | 25.0 |
| Example | 190 | 36.4 | 67.6 | 58.4 | 29.4 |
| Example | 178 | 31.6 | 66.8 | 61.0 | 30.6 |
| Annealed Product | — | 27.3 | 66.0 | 63.0 | — |

From Table 1 and microphotographs shown in FIG. 6 through 9 the following observations are obtained.

Figure 6:
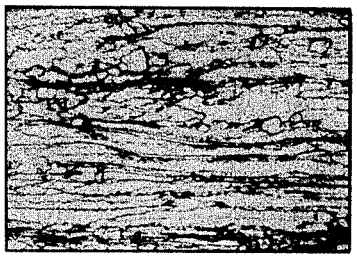
FIGS. 6 through 9 are microphotographs showing metallic structures of various coils, of which FIGS. 6 and 7 relate to controls and FIGS. 8 and 9 relates to those in accordance with the invention.

The product obtained in Control Example 1 has a metallic structure mainly comprised of unrecrystallized elongated grains retaining hot work strains, in which structure a few recrystallized austenite grains are present very locally (FIG. 6). Precipitated carbides are found on grain boundaries and deformation bands. Furthermore it has a hardness as high as Hv 254. The present obtained in Control Example 2 has recrystallization substantially completed. However, it contains carbides which have precipitated in grain boundaries. These control products are in the sensitized state and thus have a poor acid resistance. They cannot be directly subjected to a pickling process, because their surfaces are roughened in a descaling step of the pickling process. Furthermore, they have a poor formability as reflected by their high hardness and proof stress and low elongation and reduction ratio. In contrast the products obtained in Examples 1 and 2 according to the invention have a metallic structure comprising fine recrystallized austenite grains without carbides in grain boundaries. They are not hard and have mechanical properties well comparable with those of the annealed product. They have a good formability.

What is claimed is:

1. A process for the production of a coil of a hot rolled strip of austenitic stainless steel having recrystallization substantially completed and sensitization prevented, wherein a hot bar of austenitic stainless steel is hot rolled to a strip by passing through a train of finishing mill stands with a total rolling reduction and a finishing temperature controlled so that they fall within the hatched area shown in FIG. 1 of the attached drawings; and wherein the hot rolled strip so obtained is allowed to cool in air for a period of from 3 to 10 seconds, cooled with water and then coiled at a temperature of from 400° to 600° C.

2. The process in accordance with claim 1 wherein said hot bar has a thickness of from 15 to 50 mm.

* * * * *